US009149094B2

(12) United States Patent
Marks

(10) Patent No.: US 9,149,094 B2
(45) Date of Patent: Oct. 6, 2015

(54) ADAPTER FOR ORNAMENTAL ACCESSORY

(71) Applicant: Meredith Marks, Chicago, IL (US)

(72) Inventor: Meredith Marks, Chicago, IL (US)

( * ) Notice: Subject to any disclaimer, the term of this patent is extended or adjusted under 35 U.S.C. 154(b) by 200 days.

(21) Appl. No.: 13/735,832

(22) Filed: Jan. 7, 2013

(65) Prior Publication Data

US 2014/0190207 A1 Jul. 10, 2014

(51) Int. Cl.

| | |
|---|---|
| ***A44C 17/02*** | (2006.01) |
| ***A44C 9/00*** | (2006.01) |
| ***A44C 15/00*** | (2006.01) |
| *A44C 7/00* | (2006.01) |
| *A44C 13/00* | (2006.01) |
| *A44C 25/00* | (2006.01) |

(52) U.S. Cl.

CPC ..... *A44C 15/001* (2013.01); *A44C 7/002* (2013.01); *A44C 13/00* (2013.01); *A44C 25/007* (2013.01)

(58) Field of Classification Search

CPC ..... A44C 17/02; A44C 17/0208; A44C 17/0241; A44C 17/0216; A44C 9/0053; A44C 13/00; A44C 25/00; A44C 9/00

USPC ..... 63/29.1, 30

See application file for complete search history.

(56) References Cited

U.S. PATENT DOCUMENTS

| | | | | | |
|---|---|---|---|---|---|
| 569,998 | A | * | 10/1896 | Buchsbaum | 63/29.1 |
| 766,435 | A | * | 8/1904 | Fitzgerald | 63/29.1 |
| 807,546 | A | * | 12/1905 | Fitzgerald | 63/29.1 |
| 1,740,060 | A | * | 12/1929 | Baum | 63/29.1 |
| 1,889,862 | A | * | 12/1932 | Bond et al. | 63/15 |
| 4,377,939 | A | | 3/1983 | Reinsdorf | |
| 4,393,667 | A | * | 7/1983 | Reinstein et al. | 63/29.1 |
| 5,133,195 | A | * | 7/1992 | Appelbaum et al. | 63/29.1 |
| 5,438,850 | A | * | 8/1995 | Keating et al. | 63/20 |
| 6,026,658 | A | * | 2/2000 | Weller | 63/1.11 |
| 6,381,985 | B1 | | 5/2002 | Burgard | |
| 6,446,466 | B1 | | 9/2002 | Headley | |
| 2004/0016261 | A1 | * | 1/2004 | Rose | 63/29.1 |

* cited by examiner

*Primary Examiner* — Emily Morgan

(74) *Attorney, Agent, or Firm* — Beem Patent Law Firm

(57) ABSTRACT

An accessory adapter for mounting an ornamental piece with two opposing edges. The adapter has a body with two spaced members forming a cavity therebetween for receiving one of the edges. The body also has an exterior surface configured to be fixed to an anchoring portion for mounting the adapter on a human body or object. A movable member is rotatably mounted on the body and rotatable to engage the other edge of the two opposing edges to releasably secure the adapter to the ornamental piece.

26 Claims, 3 Drawing Sheets

ADAPTER FOR ORNAMENTAL ACCESSORY

BACKGROUND

1. Field of the Invention

The subject matter presented herein relates to ornamental accessories such as jewelry, and more particularly to adapters that permit a single ornamental piece to be worn on different types of accessories, or that permit different ornamental pieces to be mounted alternatively on a single adapter.

2. Description of the Related Art

Most ornamental jewelry arrangements or charms are permanently mounted on an accessory with a specific use. For example, a user cannot usually easily disconnect a diamond charm on a ring by hand and to mount the charm on an earring, necklace, or bracelet without special tools or taking the jewelry to a jeweler. Thus, it also is difficult to replace one charm with a different charm on the same mounting. For instance, a user cannot easily replace a diamond charm on a ring mounting with a gold and emerald charm without tools for example. Accordingly, it is desirable to provide a way for a user that wears the accessories to easily replace alternative ornamental objects on an accessory mounting or use the same ornamental object on different types of accessories.

SUMMARY

Figure 1:
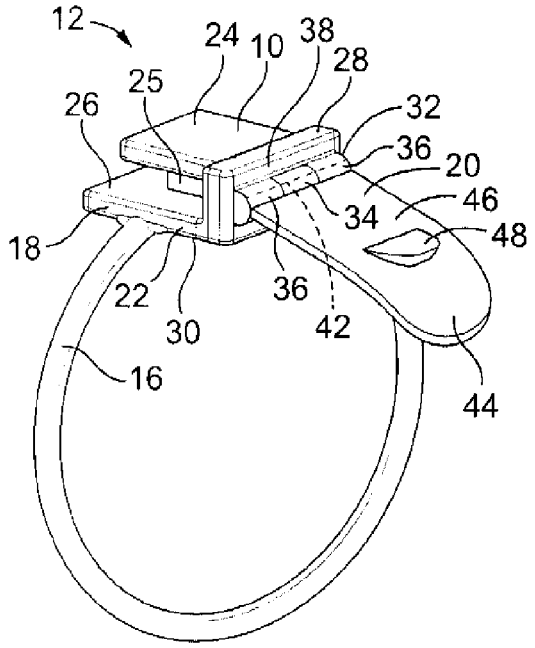
FIG. 1 is a rear perspective view of part of an accessory with an adapter according to the description herein.

The deficiencies mentioned above are solved by the accessory adapter described herein that can be used to mount alternative ornamental pieces. For example, the adapter for a ring may hold an ornamental charm with jewels in one instance, and the ornamental jewel charm may be detached from the adapter and replaced with an ornamental precious metal charm. Many other examples are contemplated. Similarly, the same adapter structure may be repeated for adapters for many different types of accessories such as a ring, necklace, and bracelet, for example, so that the same charm may be mounted on any of the adapters to be worn in many different ways.

More specifically, in one form, an accessory adapter has a body configured to engage an ornamental piece, and a movable member movably attached to the body. The movable member is movable to extend a linear length of the adapter and in a direction along the ornamental piece to tightly engage and releasably secure the adapter to the ornamental piece. The body is configured to be fixed to an anchoring portion to mount the adapter and ornamental piece on a person or object.

By another aspect, the body is configured to engage a first edge portion of the ornamental piece, and the movable member is configured to move relative to the body to engage a second edge portion of the ornamental piece and spaced from the first edge portion to releasably secure the adapter between the first and second edge portions.

It yet another aspect, the movable member has a main surface and a projection extending from the main surface and to engage the ornamental piece. The projection may extend outwardly relative to the body to form a space between the projection and main surface for receiving the ornamental piece.

In another form, an accessory adapter for mounting an ornamental piece with two opposing edges has a body with two spaced members forming a cavity therebetween for receiving one of the edges. A movable member is rotatably mounted on the body and movable to engage the other edge of the two opposing edges. In one form, the movable member is attached to the body by a hinge. An anchoring portion is attached to the body.

In yet another form, an accessory has at least one ornamental piece with a plate having an edge portion forming a gap in the plate, and at least one adaptor. The adapter has a body shaped to releasably engage the edge portion, and a movable part movably secured to the body and movable to engage the edge portion for releasably securing the adaptor within the gap. An anchoring portion is attached to the body and configured to be mounted to a part of a human body or object.

In a further form, an accessory has at least one ornamental piece with a filigree backing plate with a gap within the backing plate and an ornamental layer spaced from the backing plate. At least one adapter for the accessory has a body shaped to engage the backing plate at the gap and extend between the backing plate and the ornamental layer. A movable member rotatably engages the body and is rotatable to engage the backing plate and releasably secure the adapter within the gap. An anchoring portion is fixed to the body and configured to secure the adapter and ornamental piece to a person or object.

DETAILED DESCRIPTION OF THE INVENTION

Referring to FIG. 1, an adapter 10 is part of an accessory 12 that also includes an ornamental or decorative piece 14 (FIG. 3) and an anchoring portion 16. The ornamental piece 14 is mounted on the adapter 10 as shown in FIG. 4D. With adapter 10, the accessory 12 is extremely versatile since ornamental piece 14 can be replaced with ornamental pieces of many different ornamental arrangements as long as it is structured to attach to the adapter 10. Thus, the ornamental arrangements may be any aesthetic design such as with jewels including diamonds, emeralds, rubies, and so forth, or may provide precious metals such as gold, silver, or any combination of these, or pictures, picture frames, watch pieces, a base for other designs such as those made of fabrics, plastics, metals, or woods, to name a few more examples, or any other aesthetically pleasing presentation. Many other examples or ornamental arrangements for an ornamental piece are contemplated. Thus, one way of describing the accessory is to state that the accessory has a plurality of ornamental pieces that are alternatively mounted on the adapter 10.

Figure 5:
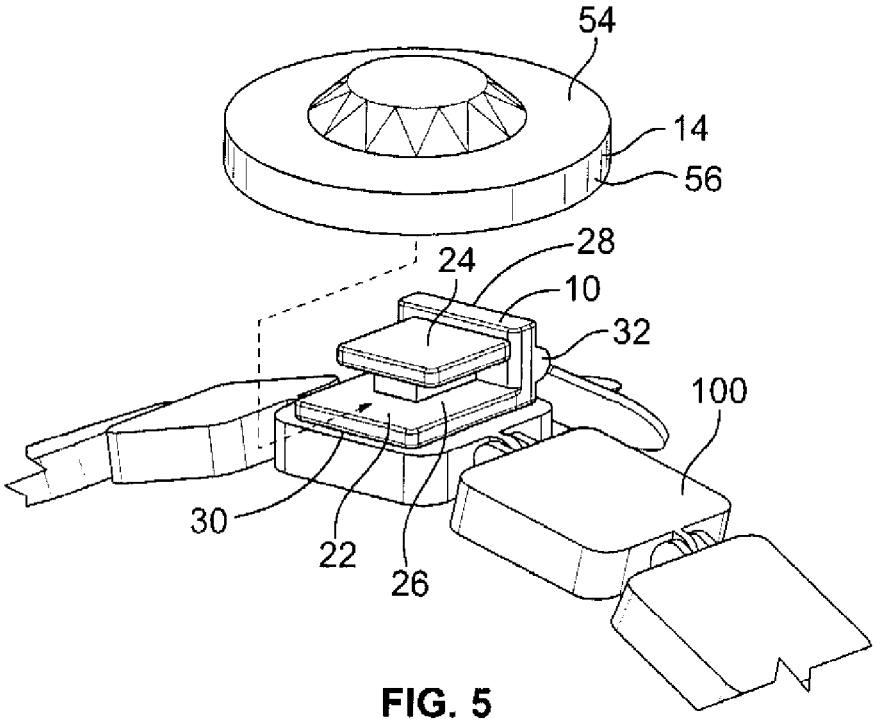
FIG. 5 is an upper perspective view showing a charm being mounted on an alternative part of an accessory with an adapter as described herein.
Figure 6:
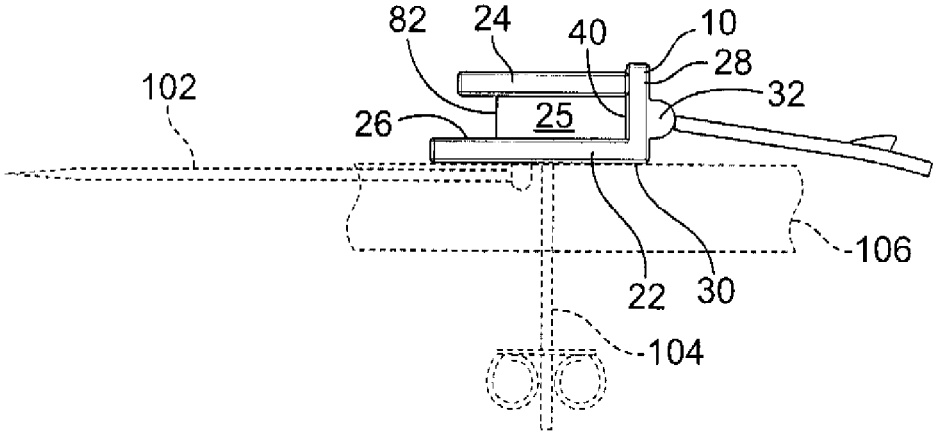
FIG. 6 is a side view of an adapter as described herein shown with alternative accessory mountings.

Also, the adapter 10 may be attached to many different anchoring portions so that the same ornamental piece can be used on many different types of accessories. Thus, the adapter 10 may be attached to anchoring portions such as a ring, bracelet, necklace, an anklet, an earring, body piercing jewelry, a device that clips to a human body part, a broche, a pin, a watch band, a belt, a belt buckle, hair holding devices, hats, clothing, and bags such as purses, carry bags, luggage, and so forth. Referring to FIGS. 5-6, example alternative anchoring portions are shown fixed to the adapter 10 such as a bracelet 100, pin 102, earring 104, and watch band or belt 106 (shown in dashed line).

The anchoring portion may include multiple pieces or may be a single piece. Many other examples are contemplated. Thus, another way to describe the accessory is to state that the accessory is one of a plurality of accessories each including an adapter 10 for alternatively engaging the same ornamental piece 16 but with a different type of anchoring portion. In other words, for example, a kit or set could be provided with multiple types of accessories such as that shown in FIGS. 1 and 5, and may or may not be provided with one or more ornamental pieces that fit on any of the accessory mounts. Of course, a kit or set may be provided with both multiple anchoring portions each fixed to an adapter and multiple different ornamental pieces as described above.

Figure 2:
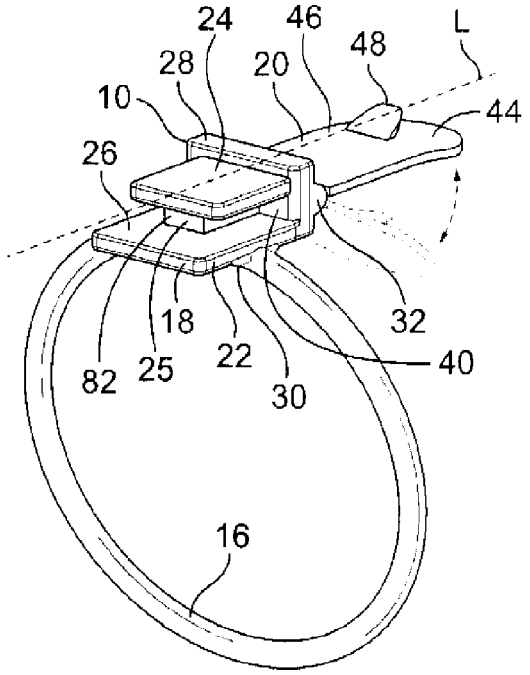
FIG. 2 is a front perspective view of part of the accessory and adapter of FIG. 1.

Referring to FIGS. 1-2, the adapter 10 includes a body 18 and a movable member 20. The body 18 has two spaced members 22 and 24, and in one form, the members are generally flat walls that extend substantially parallel to each other. A cavity 26 is formed between the spaced members 22 and 24 to receive part of the ornamental piece 14, and a stop or guide 25 (or guide block) also is disposed between the spaced members 22 and 24 as described below. A connecting portion 28, in one example in the form of a transverse wall, interconnects the two spaced members 22 and 24. In one form, the connecting portion 28 abuts an end of each spaced member 22 and 24 thereby also forming an end of the cavity 26. An exterior surface 30 of one of the spaced members may be used to attach or fix the anchoring portion 16 to the body. In one form, the anchoring portion is fixed to the body 18 by welding, soldering, fusing, or molding or casting as one integral piece, for example, so that the anchoring portion cannot be separated from the body without breaking a connection between the anchoring portion and the body or using a tool. Alternatively, the anchoring portion 16 may be detachable from the body 18 by the user.

The movable member 20 is movably attached to the body 18 so that mounting the body 18 on the ornamental piece 14 and then moving the movable member 20 to engage the ornamental piece 14 secures the adapter on the ornamental piece 14. In more detail, the movable member 20 is rotatably mounted on the body 18, and in one form, rotatably attached to the connecting portion 28 by a hinge 32. The hinge 32, in the illustrated form, extends substantially parallel to the spaced members 22 and 24. In one form, a central part 34 of the hinge 32 is fixed to, or integral with, the movable member 20, while the two end parts 36 of the hinge 32 are fixed to, or integral with, the body 18 and specifically a side 38 of the connecting portion 28 opposite a side 40 engaging the spaced members 22 and 24. The hinge 32 may include a pin 42 (shown in dashed line) or may include the center part 34 and/or end parts 36 having integral protrusions that extend into the adjacent hinge part 34 or 36. Many alternative hinge structures are contemplated including a living hinge.

The movable member 20, in one form, may be generally flat and may be generally tongue shaped with a curved distal end 44. The movable member 20 also has a main surface 46 with a projection 48 extending upwardly (in a direction opposite the direction the exterior surface 30 is facing) as well as outwardly away from the body 18 for engaging the ornamental piece 14. So configured, a space 50 is formed between the projection 48 and main surface 46 to receive the ornamental piece 14. It will be appreciated that any reference to up and down directions are merely used for orientation of the parts herein relative to each other.

Figure 3:
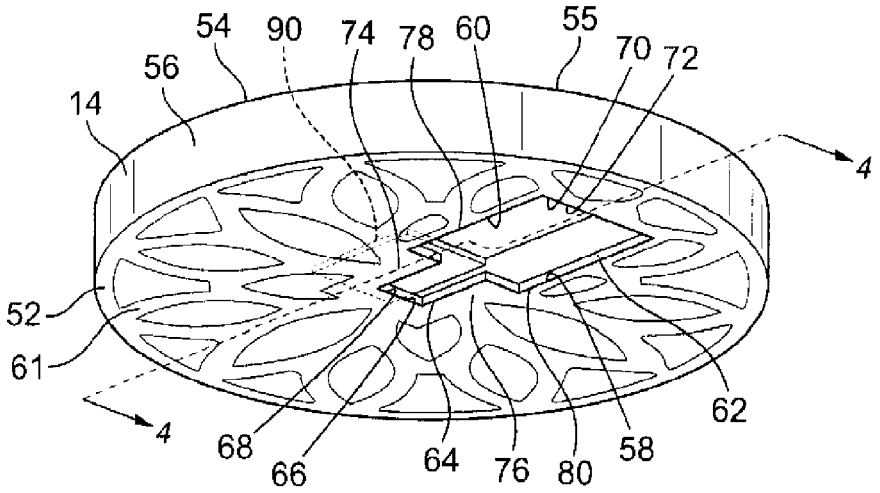
FIG. 3 is a lower perspective view of the back of a charm for mounting on the adapter of FIG. 1.
Figure 4A:
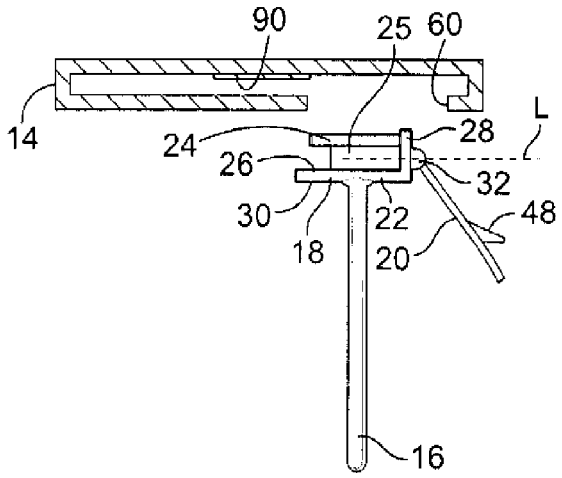
FIGS. 4A-4D is a side cross-sectional view taken along the line 4-4 on FIG. 3, and showing a process for mounting the charm of FIG. 3 onto the part of the accessory of FIG. 1.

Referring to FIGS. 3 and 4A, in one form, the ornamental piece 16 has a backing 52 such as a plate or backing plate that is spaced from an ornamental layer 54 by an outer rim 56. An exterior 55 of the ornamental layer 54 presents the decorative arrangements (whether jewels, precious metals, or other arrangements) for the ornamental piece. The backing or plate 52 has an edge portion 58 that forms a gap 60 in the backing 52 to receive the adapter 10. It will be appreciated that the backing 52 may be a continuous piece of material without any other openings other than the gap 60 or may have other functional or decorative openings such as the filigree plate 61 with many openings and forming the backing 52 in the illustrated example.

The adapter 10 engages, and is releasably secured to, the edge portion 58. More specifically, the gap 60 has a wide portion 62 and a narrower slot portion 64. The proximal end 66 of the gap 60 forming the slot portion 64 also forms a first edge portion 68 of the gap while the opposite distal end 70 of the gap 60 forms a second edge portion 72. Two side edge portions 74 and 76 extend inwardly from the sides 78 and 80 of the wide portion 62 to form the sides of the slot portion 64.

Figure 4B:
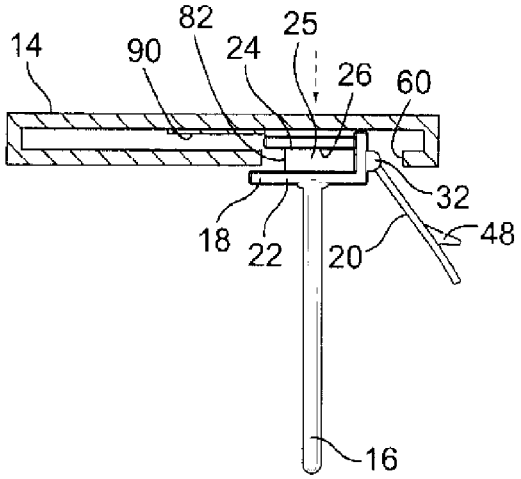
Figure 4C:
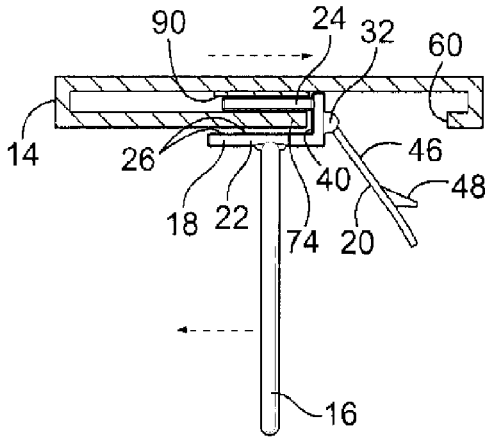
Figure 4D:
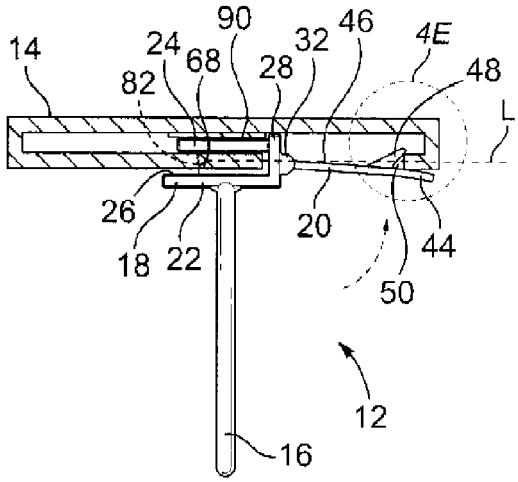

Referring to FIGS. 4B-4C, the upper wall 24 of the body 18 is sized to fit through the gap 60 so that the upper wall 24 fits between the backing 52 and ornamental layer 54, while the guide 25 is sized to slide within the slot portion 64. With the guide 25 disposed within the slot portion 64, the lower and upper walls 22 and 24 engage opposite sides of the side edge portions 74 and 76 to hold the body 18 steady thereon and limit rocking or wobbling of the ornamental piece 14 when it is mounted on the adapter 10. In one form, the upper wall 24 overhangs the side edge portions 74 and 76 by about 1.5 mm represented as W.O. (width overhang) on FIG. 7, and the first edge portion 68 (the proximal end of gap 60) by about 1.8 mm represented by L.O. (length overhang) on FIG. 7. By other approaches, the width overhang (WO) may be between about 1 mm to about 2 mm, and alternatively about 1.4 mm to about 1.6 mm, or otherwise at least about 1.5 mm at the side edge portions. Likewise, the length overhang (LO) may be about 1 mm to about 2 mm, or alternatively, about 1.7 mm to about 1.9 mm, or otherwise at least about 1.8 mm. The lower wall 22 extends under the side edge portions 74 and 76 (wo) by about 1 mm to 2 mm, alternatively 1.8 mm to 2.0 mm, and otherwise about 1.9 mm or at least about 1.9 mm. The lower wall 22 extends under the first edge portion 68 (lo) by about 2.5 mm to about 3.5 mm, or about 2.6 mm to about 2.8 mm, or otherwise about 2.7 mm or at least about 2.7 mm.

The spacing or cavity 26 between the walls 22 and 24 may be sized so that the body is held in a snug fit while still permitting the body to be removed from the slot portion 64 by hand. In one form, the height of the cavity from one wall to the other 22 and 24 is about 0.95 to 1.05 mm, or about 0.9 mm, 1.0 mm, or 0.95 mm, but otherwise slightly larger than the width of the backplate 52 such as at about 1.05 mm when the back plate is at about 1 mm thick. The overhang limits the rocking, wobbling, or other motion between the adapter and ornamental piece 60 that could loosen the connection or could result in a cumbersome or awkward feel on a user's body.

A protection member 90, such as a metal or plastic, flat plate for one example, may be disposed on the ornamental layer 54 and facing, and spaced from, the backing 52. The protection member 90 may extend over the slot portion 64 (though spaced above it) for engaging the upper wall 24 as the body 18 is mounted onto the ornamental piece 14. This may protect the ornamental layer 54. The member 90 also may be used to provide a tighter, more stable, fit for the upper wall 24 in between the backing 52 and the member 90, and in turn the body 18, when the body is fully assembled to the backing 52 and the flat wall 24 abuts the flat member 90.

To mount the adapter 10 on the ornamental member 14 (or vice-versa), the movable member 20 is rotated away from the longitudinal axis L of the body 18 into an obtuse angle with the axis for example, and so that the body 18, and particularly the upper wall 24, has clearance to be placed through the gap 60 (FIG. 4B). Once the wall 24 is through the gap 60, the adapter 10 is moved linearly and longitudinally or sideways (left in FIG. 4C) until the guide 25 is fully seated within the slot portion 64. Then, the movable member 20 is rotated back toward the longitudinal axis L so that it generally extends along the axis, and in one form extends substantially along the axis, or to where it has an acute angle with the axis L, and until the projection 48 engages the second edge portion 72 on the backing 52 (FIG. 4D). In this position where the projection 48 is engaged to the second edge portion 72, the movable member 20 is pressed against the body 18 via the hinge 32, and in turn, the proximal end 82 of the guide 25 is pressed against the first end portion 68 placing the adapter in compression. Alternatively, or additionally, the proximal side 40 of the connecting wall 28 may be pressing against the distal sides of the side edge portions 74 and 76 to increase the surface area receiving the compression force. So configured, the adapter 10 is fully and releasably secured to the ornamental piece 14, and by being held or pressed between the first and second edge portions 64 and 72.

Figure 4E:
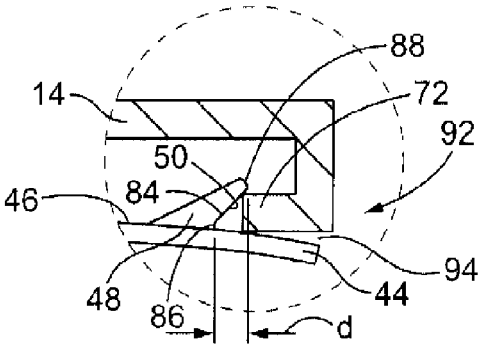
FIG. 4E is a close-up of a securing portion of FIG. 4D.

Referring to FIG. 4E, in order to limit the projection 48 from slipping loose from the second edge portion 72, the projection 48 forms the space 50 as mentioned above so that the projection is slightly or generally hook shaped to extend over the second edge portion 72 at least slightly so that it takes at least some effort to pull or push the projection passed the second edge portion 72. Thus, the projection 48, in one form, may pop or snap into place after clearing the second edge portion 72 in a mechanical interference as in a snap-fit connection. Alternatively, or additionally, the hinge 32 may be dimensioned to provide some clearance for the movable member 20 to shift slightly toward the body 18 for the projection 48 to clear the second edge portion 72. In one example projection structure, for attaching to a backing that is about 1 mm thick, the projection 48 may be about 1.2 to about 2 mm tall, and in one form, about 1.5 mm, and in another form about 1.4 mm tall. In one form, a front surface 84 forming the space 50 has a depth d from the bottom front edge 86 of the front surface 84 to the distal most end 88 of the projection 48 that is about 0.8 to 1 mm, and in one form 1.0 mm, and in another form 0.9 mm. The projection 48 may be part of one-piece with the movable member 20 by being cast or molded therewith or punched, or may otherwise be a separate piece adhered, welded, soldered, fused, and so forth onto the movable member 20.

With this configuration, after the body 18 is mounted on the backing 52 and the movable member 20 is moved or rotated toward the longitudinal axis L to secure the adapter, in effect, this increases or extends the linear length of the adapter and in a direction along the ornamental piece so that the adapter 10 fits the gap 60, and specifically to tightly engage and releasably secure the adapter to the ornamental piece 14. As mentioned above, once secure, the movable member extends substantially along the longitudinal axis, may be coplanar to the axis, or may form an acute angle with the axis. To form this releasable tight fit, in one example, the gap 60 may be about 11 to about 12 mm long from the first edge portion 68 to the second edge portion 72, or in one instance about 11.5 mm, and in another instance about 11.3 mm. For the gap length of about 11.3 mm, the corresponding adapter length from the proximal end 82 of the guide 25 to the base 86 of the projection 48 also is about 11.3 mm. In one form, the length of the slot portion 64 of the gap 60, and the corresponding shape of the adapter, is about 35% the total length of the gap between the opposite edges 68 and 72 or a ratio of about 1 to 2.8. The slot portion 64 may also have width that is about ⅓ the total width of the gap 60 at the wide portion 62.

It will be understood that other alternative structures also may extend the length of an adapter to fit a gap on the ornamental piece 14. Thus, instead of a hinge, a movable member may translate over and from the body to extend the length of the adapter. Otherwise, the hinge may be configured on the body for the movable member to swing from the sides rather than in an up or down motion.

Referring to FIG. 4E, in order to detach the ornamental piece 14 from the adapter 10, the reverse process is performed than that described above for attaching the adapter 10 to the ornamental piece 14. In order to facilitate the separation, the movable member 20 has an unlocking mechanism 92 to disengage the movable member 20 and projection 48 from the second edge portion 72. In one form, the unlocking mechanism 92 may be a curved or bent distal end 44 of the movable member 20 that extends away from the ornamental piece 14 as the movable member 20 extends outward and away from the body 18. So configured, a space 94 is formed between the movable member 20 and the second edge portion 72 for gripping and moving the movable member when the adapter is fully secured to the ornamental piece.

Other alternatives for the unlocking mechanism 92 are contemplated such as a groove at the distal end 44 of the movable member 20, or a projection or handle for gripping and pulling the movable member 20. Whether the space 94 or a groove is the unlocking mechanism, it should be sized to receive a part of a human finger or a tool for prying the movable member 20 away from the second edge portion 72.

Figure 7:
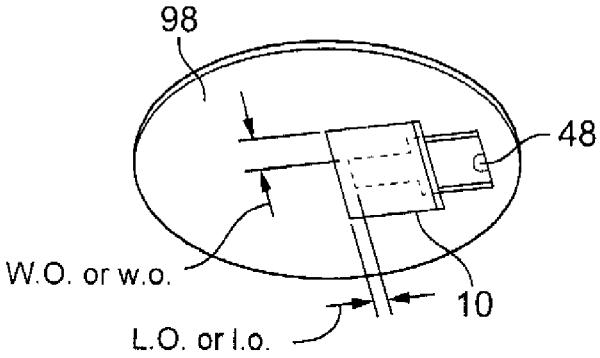
FIG. 7 is an upper perspective view of an alternative ornamental piece for use with the adapters described herein.

Referring to FIG. 7, it will be appreciated that in one alternative form, the ornamental piece may simply be a plate 96, similar to plate 52, but without other supporting structure such as rim or separate ornamental layer. Such a stand-alone plate may be decorative on the opposite side 98 the adapter is mounted on, and the wall 24 may extend to the decorative side 98 of the plate 96 and may become part of the ornamental arrangement on such a plate.

It will be understood that the adapter or anchoring portion or both may be made of many types of metal such as gold, platinum, palladium, titanium, silver, and stainless steel to name a few examples. Otherwise, the adapter 10 may also be plated with an outer metal over a filling metal. Alternatively, the adapter and anchor may be made of plastic material.

The backing plate 52, 96 may be made of any metal, plastic, wood, paper such as card board, and may other materials as well as long as it has sufficient compressive resistance to hold the adapter.

While the invention herein disclosed has been described by means of specific embodiments, examples and applications thereof, numerous modifications and variations could be made thereto by those skilled in the art without departing from the scope of the invention set forth in the claims.

What is claimed is:

1. An accessory adapter comprising:

an ornamental piece having a first edge portion and a second edge portion spaced from the first edge portion;

a body configured to engage an ornamental piece at the first edge portion, the body configured to be fixed to an anchoring portion to mount the body and ornamental piece on a person or object, the body including two spaced portions forming a cavity therebetween for receiving the first edge portion, the body further including a connecting portion interconnecting the spaced portions, the connecting portion including two opposing sides; and a movable member movably attached to the connecting portion, the moveable member movable between a first position where the moveable part does not engage the ornamental piece and a second position where the moveable member can engage the other of the second edge portion, wherein the two spaced portions extend from one side of the connecting portion and the movable member is movably attached to an opposite side of the two opposing sides of the connecting portion.

2. The accessory adapter of claim 1 further comprising a guide disposed between the two spaced portions for engaging the first edge portion.

3. The adapter of claim 1 wherein the movable member comprises an unlocking mechanism to disengage the movable member from the second edge portion.

4. The adapter of claim 3 wherein the unlocking mechanism comprises a curved or bent distal end of the movable member extending away from the body and disposed to form a space between the movable member and the second edge portion for gripping and moving the movable member when the adapter is fully secured to the ornamental piece.

5. The adapter of claim 1 wherein the two spaced portions are two substantially parallel extending walls, and the connecting portion is a wall extending transverse to the two parallel extending walls.

6. The accessory adapter of claim 1 wherein the movable member has a main surface and a projection extending from the main surface and to engage the ornamental piece.

7. The accessory adapter of claim 6 wherein the projection extends outwardly relative to the body to form a space between the projection and main surface for receiving the ornamental piece.

8. The adapter of claim 1 wherein the body defines a longitudinal axis, and wherein the movable member extends along the longitudinal axis when the movable member is in the second position.

9. The adapter of claim 1 wherein the movable member is rotatable relative to the body.

10. The adapter of claim 1 comprising a hinge for connecting the movable member to the body.

11. The adapter of claim 1 further comprising an anchoring portion is fixed to the body so that the anchoring portion cannot be separated from the body without breaking a connection between the anchoring portion and the body or using a tool.

12. The adapter of claim 1 further comprising an anchoring portion that forms at least part of one of:

a ring,
a necklace,
a bracelet,
an anklet,
an earring,
body piercing jewelry,
a device that clips to a human body part,
a broche,
a pin,
a watch band,
a belt buckle,
a hair holding device,
a hat,
clothing, and
a bag.

13. An accessory comprising:

at least one ornamental piece with a plate having at least two edge portions forming a gap in the plate;

at least one adaptor comprising:

a body shaped to releasably engage a first section of the edge portion, the body including two spaced portions forming a cavity therebetween for receiving a first edge portion, the body further including a connecting portion interconnecting the spaced portions, the connecting portion including two opposing sides, and a movable part movably secured to the body connecting portion, the moveable part moveable between a first position where the moveable part does not engage the edge portions and a second position where the moveable part can engage a second edge portion, the second section of the edge portion distal the first section of the edge portion; and an anchoring portion attached to the body and configured to be mounted to a part of a human body or object, wherein the two spaced portions extend from one side of the connecting portion and the movable part is movably attached to an opposite side of the two opposing sides of the connecting portion.

14. The accessory of claim 13 wherein the ornamental piece has a backing formed by the plate and an ornamental layer spaced from the backing, and wherein the body is configured to extend between the backing and the ornamental layer.

15. The accessory of claim 14 comprising a protection member disposed on the ornamental layer and facing, and spaced from, the backing for engaging the adapter mounted on the ornamental piece.

16. The accessory of claim 13 wherein the gap comprises a wide section and a narrow section, and wherein the body is configured to be placed through the wide section and then translated onto the narrow section.

17. The accessory of claim 13 wherein the movable part rotates relative to the body to releasably engage the edge portion.

18. The accessory of claim 13 wherein the movable part is attached to the body by a hinge.

19. The accessory of claim 13 wherein the movable part has a main surface with a projection extending from the main surface for engaging the edge portion.

20. The accessory of claim 19 wherein the projection extends outward away from the body to form a space between the projection and main surface to receive the backing.

21. The accessory of claim 19 wherein the movable member comprises a curved or bent distal end to receive a part of a finger or tool to move the movable member.

22. The accessory of claim 13 comprising a plurality of ornamental pieces each having the plate for being alternatively mounted on an adapter.

23. The accessory of claim 13 being one of a plurality of accessories each with the adapter for being alternatively engaged to the ornamental piece, the plurality of adapters providing anchor portions for a plurality of different types of accessories.

24. The accessory of claim 13 wherein the plate is a filigree plate.

25. The accessory of claim 13 wherein the ornamental layer holds jewels or precious metals.

26. An accessory comprising:

at least one ornamental piece with a filigree backing plate having a gap within the backing plate and an ornamental layer spaced from the backing plate, the gap having at least two opposing edges;

at least one adapter comprising:

a body shaped to engage the backing plate at a first edge of the two opposing edges of the gap and extend between the backing plate and the ornamental layer, the body including two spaced portions forming a cavity therebetween for receiving an opposing edge, the body further including a connecting portion interconnecting the spaced portions, the connecting portion including two opposing sides, a movable member rotatably attached to the body connecting portion, the moveable member rotatable between a first position where the moveable member does not engage the opposing edges and a second position where the moveable member can engage member engages the other of the opposing edges; and an anchoring portion fixed to the body and configured to secure the adapter and ornamental piece to a person or object, wherein the two spaced portions extend from one side of the connecting portion and the movable member is movably attached to an opposite side of the two opposing sides of the connecting portion.

* * * * *